US007358018B2

(12) United States Patent
Taguchi

(10) Patent No.: US 7,358,018 B2
(45) Date of Patent: Apr. 15, 2008

(54) SUBSTRATE FOR ELECTROPHOTOGRAPHIC PHOTORECEPTOR, PROCESS FOR PRODUCING THE SUBSTRATE, AND ELECTROPHOTOGRAPHIC PHOTORECEPTOR EMPLOYING THE SUBSTRATE

(75) Inventor: Susumu Taguchi, Niigata (JP)

(73) Assignee: Mitsubishi Chemical Corporation, Tokyo (JP)

( * ) Notice: Subject to any disclaimer, the term of this patent is extended or adjusted under 35 U.S.C. 154(b) by 0 days.

(21) Appl. No.: 11/218,640

(22) Filed: Sep. 6, 2005

(65) Prior Publication Data

US 2006/0062592 A1 Mar. 23, 2006

Related U.S. Application Data

(63) Continuation of application No. PCT/JP2004/002636, filed on Mar. 3, 2004.

(30) Foreign Application Priority Data

Mar. 4, 2003 (JP) ..... P. 2003-056992

(51) Int. Cl.
*G03G 5/10* (2006.01)

(52) U.S. Cl. ..... 430/69; 399/116; 399/159; 428/141

(58) Field of Classification Search ..... 430/56, 430/69; 399/116, 159; 428/600, 601, 687, 428/141, 925

See application file for complete search history.

(56) References Cited

U.S. PATENT DOCUMENTS

| | | | | |
|---|---|---|---|---|
| 5,595,845 | A | 1/1997 | Maeda et al. | |
| 6,468,138 | B1 * | 10/2002 | Toyama et al. | 451/49 |
| 2003/0118366 | A1 * | 6/2003 | Nukada et al. | 399/109 |
| 2006/0006559 | A1 * | 1/2006 | Nakagawa et al. | 264/2.5 |
| 2006/0146575 | A1 * | 7/2006 | Saito | 362/625 |

FOREIGN PATENT DOCUMENTS

| | | |
|---|---|---|
| CN | 1117149 A | 2/1996 |
| EP | 0 686 878 A1 | 12/1995 |
| JP | 58-194039 | 11/1983 |
| JP | 60-101545 | 6/1985 |

(Continued)

OTHER PUBLICATIONS

Patent Abstracts of Japan English-language abstract describing Japanese Patent 01-185554 (pub. Jul. 1989).*

(Continued)

*Primary Examiner*—Janis L. Dote
(74) *Attorney, Agent, or Firm*—Oblon, Spivak, McClelland, Maier & Neustadt, P.C.

(57) ABSTRACT

An electrophotographic photoreceptor substrate which can be easily produced with high productivity and prevents the occurrence of image defects, and which has fine grooves formed in the surface thereof and is characterized in that the grooves are curved and discontinuous when the substrate surface is developed on a plane.

7 Claims, 6 Drawing Sheets

FOREIGN PATENT DOCUMENTS

| | | | |
|---|---|---|---|
| JP | 60-112049 | | 6/1985 |
| JP | 01-185554 | * | 7/1989 |
| JP | 1-316752 | | 12/1989 |
| JP | 8-54747 | | 2/1996 |
| JP | 8-243510 | | 9/1996 |
| JP | 9-6031 | | 1/1997 |
| JP | 9-114118 | | 5/1997 |
| JP | 10-123737 | | 5/1998 |
| JP | 2003-098356 | * | 4/2003 |
| WO | WO 2005/001334 A1 | * | 1/2005 |

OTHER PUBLICATIONS

Japanese Patent Office machine-assisted translation of JP 2003-098356 (pub. Apr. 2003).*

Diamond, A.S., ed., *Handbook of Imaging Materials*, Marcel Dekker, NY (1991), pp. 395-396.*

USPTO English-language translation of JP 01-185554 (pub. Jul. 1989).*

* cited by examiner

SUBSTRATE FOR ELECTROPHOTOGRAPHIC PHOTORECEPTOR, PROCESS FOR PRODUCING THE SUBSTRATE, AND ELECTROPHOTOGRAPHIC PHOTORECEPTOR EMPLOYING THE SUBSTRATE

FIELD OF THE INVENTION

The present invention relates to a technique for preventing the interference fringes which appear on printed images and are a kind of image defect attributable to electrophotographic photoreceptors. It specifically relates to a technique for substrate surface roughening which is simple, attains high productivity, and prevents the occurrence of other image defects also.

BACKGROUND ART

The substrate materials mainly used in electrophotographic photoreceptors include cylinders made of aluminum or an aluminum alloy, substrates made of a resin coated with aluminum by vapor deposition, and belts made of stainless steel or a nickel alloy. However, there are cases where the unevenness of density which is called interference fringes occurs on the image because the substrate surface has reduced roughness and hence has a high reflectance.

This density unevenness is attributable to the phenomenon in which the writing light emitted from a laser or LED is reflected by the substrate surface and interfaces between coating films and interferes to cause the light acting on the charge-generating layer to have unevenness in intensity due to slight differences in the thickness of each coating film, resulting in sensitivity differences among parts.

A method effective in preventing the interference fringe defects is to roughen the substrate interface. Various surface-roughening techniques have been proposed (patent documents 1 to 8).

[Patent Document 1]
JP-A-2000-105481

[Patent Document 2]
JP-A-6-138683

[Patent Document 3]
JP-A-2001-296679

[Patent Document 4]
JP-A-5-224437

[Patent Document 5]
JP-A-8-248660

[Patent Document 6]
JP-A-11-327168

[Patent Document 7]
JP-A-6-138683

[Patent Document 8]
JP-A-1-123246

DISCLOSURE OF THE INVENTION

Known surface-roughening techniques heretofore in use include a method in which suspended abrasive grains are blown against the surface to form recesses/protrusions, such as honing or blasting, (see, for example, patent document 1) and a technique in which a substrate is ground with a material harder than the substrate, such as, e.g., a grinding wheel (see, for example, patent document 2). However, the method in which suspended abrasive grains are blown to form recesses/protrusions has a problem that abrasive grains are apt to remain on the substrate surface to cause image defects. Although to wash off the abrasive grains in a later step in order to eliminate the problem may be effective (see, for example, patent document 3), it is difficult to completely remove the abrasive grains which have bitten into the surface. Furthermore, the efficiency of removal from the surfaces of ductile materials in general use as electrophotographic photoreceptor substrates, such as aluminum and aluminum alloys, is lower than in the case of brittle materials such as glass. The productivity in this technique is hence considered to be not so high.

Blasting techniques using ice or dry ice also have been proposed (see, for example, patent documents 4 to 6). However, these are wasteful processes from the standpoint of energy efficiency, for example, because of the use of a low temperature and the necessity of ejecting particles having a small specific gravity at a high speed. In addition, since one abrasive grain forms only one recess/protrusion, the blasting techniques have a problem that they have poorer productivity than the grinding method in which abrasive grains are rubbed against the surface. In case where abrasive grains having an increased particle diameter are used here so as to heighten productivity, this poses a problem that the resultant recesses/protrusions are too large and this substrate gives an electrophotographic photoreceptor which is apt to suffer charge leakage to cause defects in images, such as minute black spots.

The grinding with a grinding wheel has high productivity. However, there is a problem that since a grinding wheel lacks flexibility, surface irregularities thereof are transferred to the substrate surface and deep recesses/protrusions leading to image defects are apt to be formed (see, for example, patent document 7). It is therefore necessary to take an additional measure to remove large recesses/protrusions by some method after the processing. Although a grinding wheel comprising abrasive grains having a small particle diameter can be used, this poses a problem that productivity decreases and clogging is apt to occur.

In the surface roughening with suspended abrasive grains, such as honing or blasting, and the grinding with a grinding wheel, the amount of a surface layer to be removed for evenly roughening the whole surface is as large as several tens of micrometers or more. There are hence a problem that the processing results in an increased waste amount and it is necessary that the amount to be removed should be taken into account when determining the outer diameter of the substrate.

There is a technique in which recesses/protrusions are formed by turning with a lathe (see, for example, patent document 8). However, even a slight change in surface roughness influences the generation of interference fringes and, hence, meticulous care should be taken to maintain/regulate turning conditions. In the case of turning, to begin with, since highly regular continuous grooves are formed in a direction almost perpendicular to the axis of the substrate, the reflected light of a writing light incident on the photoreceptor is scattered only in specific planes parallel to the axis of the substrate and the effect of inhibiting interference fringes is intrinsically low.

An undercoat layer having a thickness of about several micrometers is often formed beneath the photosensitive layer as a measure against image defects, such as black spots in images and dust fogging, or for the purpose of stabilizing electrophotographic properties. However, the undercoat layer in general use which comprises a nylon resin and titanium oxide dispersed therein has high light transmission and is less effective in preventing interference fringes.

For the reasons shown above, there has been a desire for a technique for substrate surface roughening which is simple, attains high productivity, and prevents the occurrence of other image defects also.

The present inventor made intensive investigations in order to overcome the problems described above. As a result, it has been found that when a groove pattern comprising many fine grooves is formed at least in almost the whole image formation region in the surface of a substrate so that the grooves are curved and discontinuous when the substrate is developed into a plane, then it is possible to prevent, by a simple process, the occurrence of interference fringes and other defects also. The invention has been thus achieved.

Accordingly, a first essential point of the invention resides in a substrate for electrophotographic photoreceptors which has a groove pattern made by forming many fine grooves at least in almost the whole image formation region in the substrate surface, characterized in that the grooves are curved and discontinuous when the substrate surface is developed on a plane.

A second essential point thereof resides in a process for producing an electrophotographic photoreceptor substrate, characterized by bringing at least one flexible material into contact with the surface of a substrate and causing the flexible material to travel on the substrate surface. A third essential point of the invention resides in an electrophotographic photoreceptor which employs the substrate. Furthermore, a fourth essential point thereof resides in an image-forming apparatus and a cartridge each employing the photoreceptor.

In the invention, the grooves formed in the surface of a substrate so as to be curved and discontinuous serve to disorder the regularity of the light reflected by the substrate surface and to further disorder interference with the light reflected by a coating film interface. As a result, the effect of inhibiting interference fringes can be heightened. In the case of straight grooves, reflected light is scattered by the grooves in directions having specific angles. However, formation of curved grooves brings about subtle changes in the directions in which reflected light is scattered. Furthermore, when such grooves are formed so as to be discontinuous, the directions of reflected light change at groove intersections. As a result, the directions of the light reflected by the substrate surface are complicated and the effect of inhibiting interference fringes is enhanced.

In the case where grooves are formed by turning, the grooves are straight and continuous and the groove regularity is exceedingly high. The effect of inhibiting interference fringes is hence low as stated above. In the grinding with a grinding wheel, discontinuous grooves which are short and straight are formed but the substrate surface comes to have large recesses/protrusions and are apt to cause image defects as stated above. It is therefore necessary to conduct an additional step for removing large recesses/protrusions, resulting in a complicated process.

As described above, the electrophotographic photoreceptor substrate of the invention prevents the occurrence of image defects such as black spots while completely preventing the fringes attributable to exposure light interference, whereby satisfactory images can be obtained.

Figure 1:
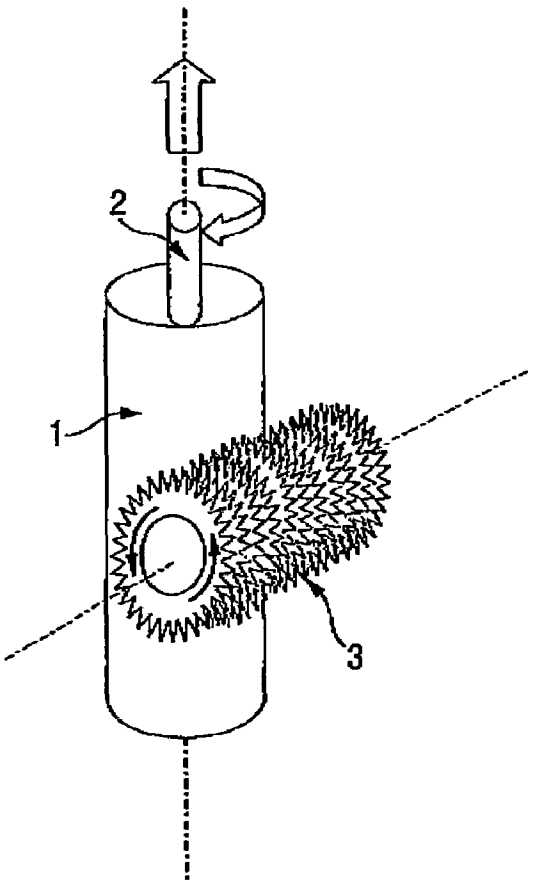
FIG. 1 is a view illustrating one example of processes for producing an electrophotographic photoreceptor substrate of the invention.

Reference numerals and signs in the figures areas follows.

1: substrate
1', 10', 21': substrate surface developed into plane
2: expanding/holding mechanism
3: wheel-shaped brush
3': cup-shaped brush
4: cleaning brush
10, 21: raw pipe
11: cutting tool
11A: tip of cutting tool
12: tool holder
13; guide pipe
14: bed
15; slide stage
16: head
22: punch
23: die holder
24: claw
25: hydraulic cylinder
26: punch holder plate
27; guide
28: jig
29: pump

BEST MODE FOR CARRYING OUT THE INVENTION

Embodiments of the invention will be explained below in detail. However, the constituent elements described below are typical examples in embodiments of the invention and can be suitably modified, in practicing the invention, as long as this is not counter to the spirit of the invention.

(Substrate)

The electrophotographic photoreceptor substrate of the invention has, formed in the surface thereof, grooves characterized by being curved and discontinuous when the substrate surface is developed on a plane (hereinafter these grooves are suitably referred to as "arc grooves").

Usable as the substrate in which the arc grooves characteristic of the invention are to be formed are ones employed in known electrophotographic photoreceptors. Examples thereof include drums or sheets made of a metallic material such as aluminum, stainless steel, copper, or nickel, substrates coated with a foil of any of these metals by laminating or vapor deposition, and insulating substrates, e.g., a polyester film or paper, which have a surface coated with an electroconductive layer made of aluminum, copper, palladium, tin oxide, indium oxide, or the like. Examples thereof further include plastic films, plastic drums, paper, paper tubes, and the like which each have undergone a conductivity-imparting treatment by applying an electrically conductive material, e.g., metal particles, carbon black, copper iodide, or polyelectrolyte, thereto together with an appropriate binder. Other examples include sheets or drums made of a plastic to which electrical conductivity has been imparted by incorporating an electrically conductive material, e.g., metal particles, carbon black, or carbon fibers, thereinto. Still other examples include plastic films or belts which have undergone a conductivity-imparting treatment with an electrically conductive metal oxide such as tin oxide or indium oxide.

Preferred of those substrates are endless pipes of metals, e.g., aluminum. In particular, an endless pipe of aluminum or an aluminum alloy (hereinafter sometimes inclusively referred to as aluminum) is suitable for use as the electrophotographic photoreceptor substrate of the invention. An endless aluminum pipe formed by an ordinary processing technique, e.g., extrusion or drawing, may be used as it is or after it is further subjected to a processing, such as turning, grinding, or polishing. Furthermore, after the arc grooves characteristic of the invention are formed, an interlayer such as a barrier layer may be formed. As the barrier layer is used, for example, an anodized aluminum coating film, an inorganic layer made of aluminum oxide, aluminum hydroxide, or the like, or an organic layer made of poly(vinyl alcohol), casein, polyvinylpyrrolidone, poly(acrylic acid), cellulose derivative, gelatin, starch, polyurethane, polyimide, polyamide, or the like.

The arc grooves characteristic of the invention are formed by bringing a flexible material as a rubbing material into contact with the surface of the substrate and causing the rubbing material to travel on the substrate surface. The rubbing material deforms in the contact part and, hence, the rate of rubbing changes in the period from the initiation of contact to termination. Because of this, the resultant arc grooves have a curved shape. In substrates in general use which have a curved surface, the arc grooves have a curved shape as long as the rubbing material is contacted with the substrates in such a manner that the axis of rotation of the substrate is not parallel to that of the rubbing material. Namely, in forming the arc grooves according to the invention, the substrate and the rubbing material are positioned so that their axes of rotation are not parallel to each other. Grooves other than arc grooves may have been formed in the surface of the substrate of the invention. The grooves other than arc grooves will be explained later in connection with processes for substrate production.

Examples of the flexible material include rubbers, resins, sponges, brushes, cloths, and nonwoven fabrics. However, the flexible material should not be construed as being limited to these. From the standpoint of heightening the efficiency of arc groove formation, those flexible materials preferably are ones containing abrasive grains. Brush materials are more preferred.

Any abrasive grains may be used as long as they have a hardness sufficient to form arc grooves in the substrate in which arc grooves are to be formed. Known abrasive grains such as silicon carbide, silicon nitride, boron nitride, and alumina can be used. However, abrasive alumina grains are preferred for aluminum substrates. With respect to particle diameter, abrasive grains ranging from #240 to #2500 as prescribed for in JIS R 6001 can be generally used. Of these, ones of #280 or above are preferred and ones of #320 or above are more preferred. Furthermore, ones of #2000 or below are preferred and ones of #1500 or below are preferred.

In case where a material having almost no flexibility, such as, e.g., a grinding wheel, is used, deep flaws are partly formed in the surface. Use of such a material is hence undesirable. Although use of fine abrasive grains is effective in forming shallower grooves, this case not only results in reduced productivity but poses the problem of clogging. There are cases where an aluminum alloy is used as a substrate. However, since the grinding powder particles which have caused clogging are apt to be transferred to the aluminum surface, which is soft, the particles are apt to cause foreign-matter defects. In addition, since a grinding wheel undergoes almost no deformation in its contact part, the resultant grooves are short and straight.

The bristles to be used preferably are ones made of a resin, e.g., a nylon, which contains abrasive grains incorporated therein through kneading. In grinding brushes in general use, the grinding power of the bristle tips is mainly utilized. In contrast, in the brush containing abrasive grains to be used in the invention, grinding by the trunks of the bristles can be effectively used and, hence, the contact part can be enlarged, resulting in heightened productivity. Furthermore, owing to the elasticity of the bristles, mild grinding is possible which forms recesses/protrusions which are not excessively large and results in a reduced amount removed. In addition, clogging is less apt to occur because of the flexibility of the bristles and because the contact part always shifts. Owing to this feature, it is possible to use abrasive grains which are too small in particle diameter to be used in wheel grinding because of clogging. Since the surface roughness can be easily reduced, this technique is highly effective also against image defects other than interference fringes. The high irregularity of the arc grooves to be formed also brings about the high effect of inhibiting interference fringes.

To conduct the processing two or more times under different conditions to form arc grooves in lattice pattern arrangement is preferred because this can further enhance irregularity. It is especially preferred that the substrate should have such surface roughness that the maximum height/roughness Rz thereof as prescribed for in JIS B 0601: 2001 is $0.6 \leqq Rz \leqq 2$ μm, the kurtosis Rku in a roughness curve thereof is 3.9≦Rku≦30, and the groove width L of the substrate surface is 0.5≦L≦6.0 μm.

Too large values of Rz tend to result in defects such as black spots in images. Consequently, Rz is generally 2 μm or smaller, preferably 1.8 μm or smaller, more preferably 1.6 μm or smaller. On the other hand, in case where Rz is too small, the effect of scattering reflected light is insufficient. Consequently, the Rz of the substrate to be used is generally 0.6 μm or larger, preferably 0.8 μm or larger, more preferably 1.0 μm or larger.

Rku, which indicates the kurtosis of a roughness distribution waveform, gradually decreases with the progress of surface roughening and converges to a value around 3, although this varies slightly depending on processing methods. In the case of techniques heretofore in use such as honing and blasting, Rku is generally about 2.5-3. In the case of turning with a cutting tool, Rku is generally about 2-3 due to the formation of serrate recesses/protrusions.

When the substrate surface is in such a state that the arc grooves formed are scatteringly present, Rku has a large value. This value becomes small as the surface roughening proceeds. Consequently, a smaller value is attained by increasing the number of processing operations in arc groove formation and/or prolonging the processing time. However, the Rku of the substrate to be used is generally 3.9 or larger, preferably 4.2 or larger, more preferably 4.5 or larger when practical productivity is taken into account, and is generally 30 or smaller, preferably 15 or smaller, more preferably 10 or smaller when image defects are taken into account.

Too small values of groove width L necessitate the formation of many grooves and result in reduced productivity. Consequently, the substrate to be used has an L of generally 0.5 μm or larger, preferably 0.6 μm or larger, more preferably 0.7 μm or larger. In case where L is too large, the recesses/protrusions have a depth increased accordingly and this is apt to cause image defects. Consequently, the substrate to be used has an L of 6.0 μm or smaller, preferably 4.0 μm or smaller, more preferably 3.0 μm or smaller.

Rz, Rku, and groove width L can be controlled by regulating the length, hardness, and setting density of the bristles to be used, properties, e.g., particle diameter, of the abrasive grains to be incorporated into the bristles by kneading, and processing conditions including the revolution speed of the bristles and the time period of contact.

Rz and groove width L, among those properties, are especially influenced considerably by the particle diameter of the abrasive grains to be incorporated into the bristles by kneading. Large abrasive-grain diameters tend to result in large values of Rz and groove width L, while small abrasive-grain diameters tend to result in small values of Rz and groove width L. Consequently, abrasive grains having a particle diameter which is generally 1 μm or larger, preferably 5 μm or larger, and is generally 50 μm or smaller, preferably 35 μm or smaller, are used.

Rku is affected by the frequency of brush contacts and, in particular, varies depending on the revolution speed, processing time, and number of processing operations. In general, Rku is large in the beginning of processing and decreases with the progress of the processing. Consequently, a substrate having the desired arc grooves formed therein can be obtained by measuring the Rku during processing and terminating the processing when the Rku has reached a value within the range specified in the invention.

(Production Processes)

An example of processes for producing the electrophotographic photoreceptor substrate of the invention is shown in FIG. 1. A substrate (1) is held by an expanding/holding mechanism (2) and rotated on its axis. A wheel-shaped brush (3) is disposed so as to be in contact with the substrate. The brush is caused to travel on the substrate while rotating on its axis. In the case of using a wheel-shaped brush, the direction of rotation is not particularly limited. It is, however, preferred that the direction of brush movement on the substrate surface be the same as the direction of the travel of the whole brush on the substrate. The direction of the travel of the whole brush on the substrate is not limited as long as the substrate is in contact with the brush and the whole substrate surface corresponding to an image formation region comes into contact with the brush. Preferably, however, the brush travels on the substrate in a direction parallel to the axis of the substrate.

Although it is generally sufficient to conduct the travel of the brush on the substrate once, the travel may be conducted two or more times. In the case where the brush is caused to travel two or more times, it may travel always in the same direction or may travel on the substrate in a reciprocating manner. In the case of a wheel-shaped brush, the brush is positioned so that the brush axis is not parallel to the substrate in order to form the arc grooves according to the invention. The brush is preferably disposed in such a position that the brush axis and the substrate axis are not coplanar (torsional position) for the purpose of preventing uneven contact due to the tilting of the substrate and brush axis and to the partial wear of the brush from resulting in processing unevenness. In case where the axis of rotation of the substrate is parallel to the brush axis, the curved and discontinuous arc grooves characteristic of the invention cannot be formed. In addition, when the axis of rotation is parallel to the brush axis, that brush-axis-direction unevenness in the polishing power of the brush which is caused by a difference in bristle length or density is directly transferred to the substrate surface. As a result, the state of the substrate surface thus polished is uneven in the axis direction. Although the technique in which either of the brush and substrate is oscillated on the other in the axis direction, such as that disclosed in JP-A-9-114118, is effective in diminishing local unevenness of processing, the substrate thus processed has processing unevenness when viewed over the whole axis direction.

Figure 2:
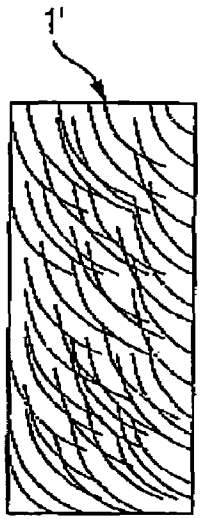
FIG. 2 is a diagrammatic view showing one example of groove shapes in an electrophotographic photoreceptor substrate of the invention which has been developed into a plane.
Figure 3:
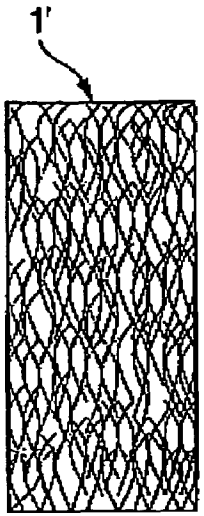
FIG. 3 is a diagrammatic view showing one example of groove shapes in an electrophotographic photoreceptor substrate of the invention which has been developed into a plane.

In the case where a substrate (1) and a wheel-shaped brush (3) are disposed so that the axis of the substrate (1) is nearly perpendicular to the axis of the brush (3) as shown in FIG. 1, arc grooves which are oblique when the substrate (1) is developed, such as those shown in FIG. 2, are formed by setting the brush revolution speed at a low value and the working area at a small value. When a high brush revolution speed and a large working area are used, arc grooves in oblique lattice pattern arrangement, such as those shown in FIG. 3, are formed. The latter method is more preferred because of its high productivity.

Figure 4:
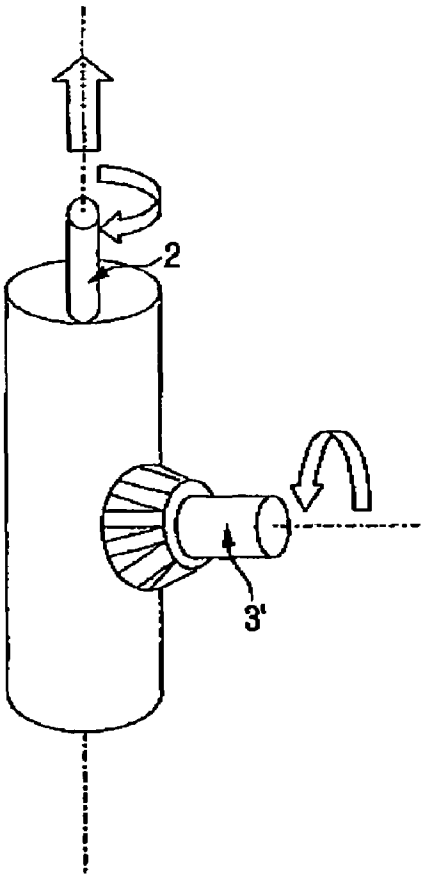
FIG. 4 is a view illustrating another example of processes for producing an electrophotographic photoreceptor substrate of the invention.

Although this example employs a wheel-shaped brush, a brush of another shape, e.g., a cup-shaped brush such as the brush (3') shown in FIG. 4, may be used. In the case of a cup-shaped brush, the brush axis and the substrate axis may be coplanar as long as the two axes are not parallel with each other. In the case of a wheel-shaped brush, it may be one formed by setting bristles into a support in zigzag arrangement. However, the wheel-shaped brush preferably is one formed by, e.g., winding a channel brush around a shaft so as to have a higher setting density.

Figure 5:
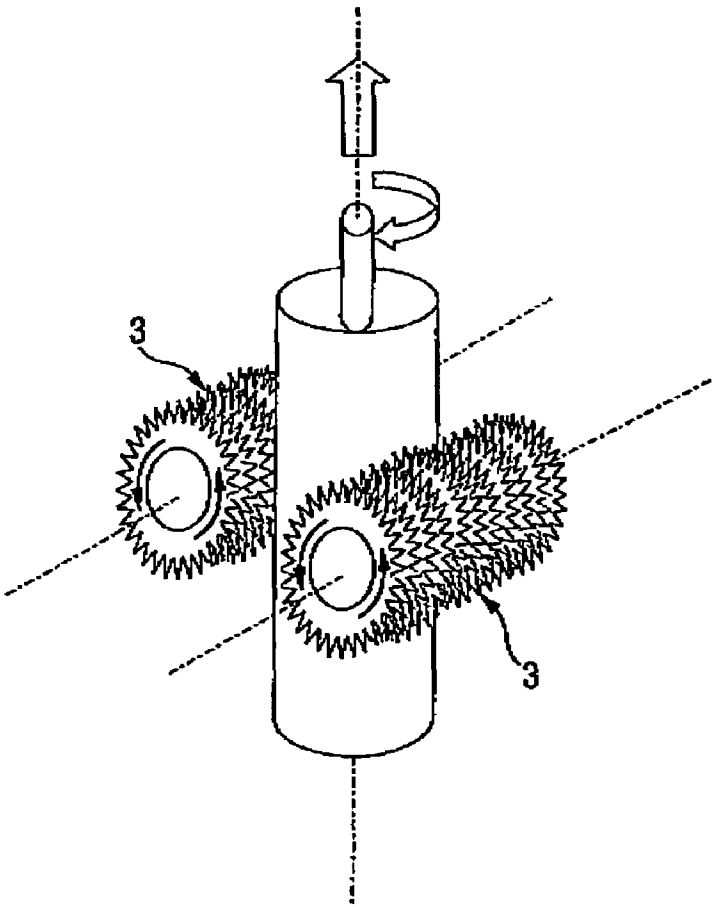
FIG. 5 is a view illustrating a still other example of processes for producing an electrophotographic photoreceptor substrate of the invention.

It is also possible to use two or more brushes as shown in FIG. 5. Use of two or more brushes improves productivity. In addition, since a roughened surface having a more complicated shape is obtained by operating the brushes under different revolution conditions, the effect of inhibiting interference fringes is further improved.

It is preferred that the processing for surface roughening be conducted while sprinkling a cleaning liquid on the substrate or immersing the substrate in a cleaning liquid in order to remove from the substrate surface the polishing dust and the abrasive grains which have shedded. As the cleaning liquid may be used any of various detergents including organic ones and water-based ones. For the purpose of preventing the adhesion of fine particles, an ammoniacal water such as that for use in semiconductor cleaning may also be used.

Figure 6:
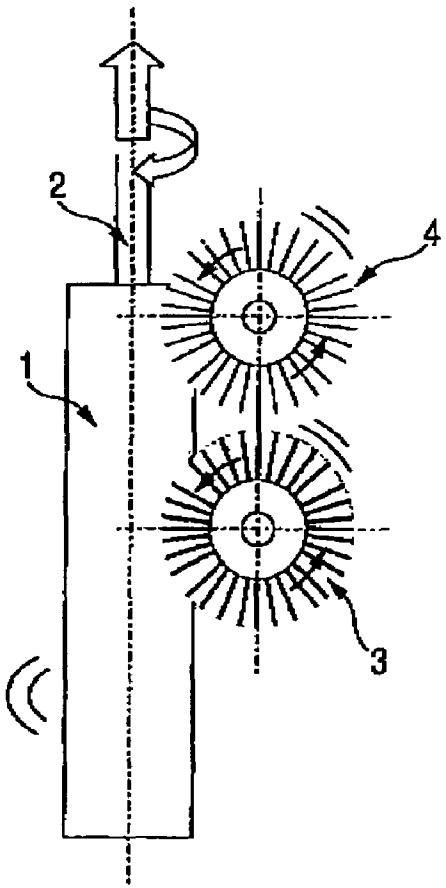
FIG. 6 is a view illustrating a further example of processes for producing an electrophotographic photoreceptor substrate of the invention.

As a result of the processing for surface roughening, a fresh surface of the substrate material is exposed. Because of this, in the case where coating is not conducted immediately after the processing, a process oil can be used, in place of a cleaning liquid, for preventing surface corrosion during the surface roughening processing to thereby protect the surface. In such cases also, it is preferred to conduct finish cleaning after the processing for surface roughening and before a coating step. It is more preferred from the standpoint of heightening productivity that a surface roughening step be incorporated into a substrate cleaning step before the coating step. For example, as shown in FIG. 6, a surface roughening brush (3) according to the invention is disposed just under a cleaning brush (4), whereby the substrate can be powerfully cleaned physically immediately after surface roughening. Namely, surface roughening can be conducted while maintaining a clean substrate surface state.

Although the method for forming arc grooves in a substrate of the invention is as described above, the substrate of the invention can be subjected to any desired processings before the formation of arc grooves. Such processings include the processings conducted in forming the substrate described above, such as extrusion, drawing, turning, grinding, and polishing. In many cases, the substrate in which arc grooves are to be formed usually has a smooth mirror surface. When this mirror surface is roughened by the method described above, arc grooves only are formed in the substrate surface as shown in FIG. 2 or 3. However, when the substrate is subjected to any of various processings prior to the formation of arc grooves, grooves which are not arc grooves are formed in the substrate surface according to the processing. In the case where some processing is performed prior to the formation of arc grooves, surface roughening may be conducted by the methods shown by the flow charts given in FIG. 7(*a*) to (*c*). The methods shown in FIG. 7(*a*) to (*c*) will be explained below in detail by reference to case examples. It should, however, be noted that the invention is not limited to the constitutions of the following case examples and can be practiced after any desired modifications.

(Case 1)

Figure 7:
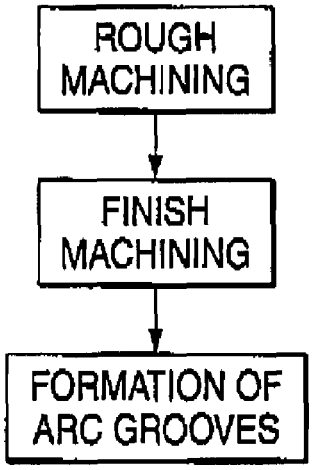
FIG. 7(*a*) to (*c*) each are a flow chart showing a method of surface roughening in producing an electrophotographic photoreceptor substrate of the invention.
Figure 7:
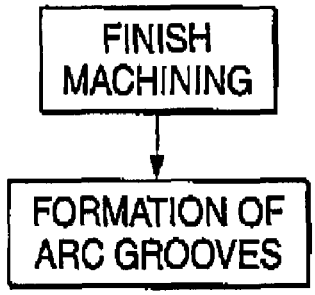
Figure 7:
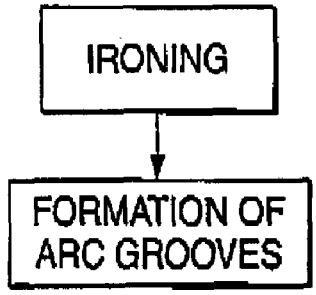

Prior to the formation of arc grooves, the substrate surface may be subjected, for example, to rough turning and finish turning beforehand as shown in, e.g., FIG. 7(*a*). An explanation is given below in which a cylindrical pipe having a smooth surface and formed by extrusion and drawing (hereinafter suitably referred to as "raw pipe") is used as an example of the substrate in which arc grooves are to be formed.

Figure 8:
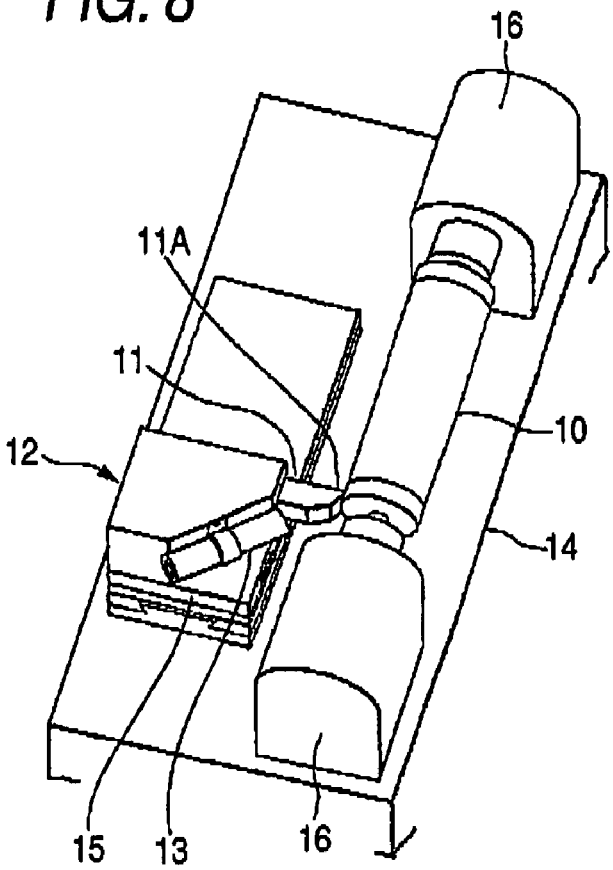
FIG. 8 is a slant view of a turning apparatus for use in producing an electrophotographic photoreceptor substrate of the invention.

FIG. 8 is a slant view showing an example of turning apparatus for use in the rough turning and finish turning of raw pipes. As shown in FIG. 8, the turning apparatus, which is an apparatus for turning the periphery of a cylindrical raw pipe 10 with a cutting tool 11, comprises the cutting tool 11, a tool holder 12, a guide pipe 13, a bed 14, a slide stage 15, and heads 16.

The cutting tool 11 is a straight tool for turning the raw pipe 10. As the cutting tool 11 is generally used a solid tool or tipped tool in which a tip 11A has been integrally formed with a shank having a rectangular section, a built-up tool in which a tip has been removably fixed to an end of a shank, or the like. Here, the apparatus employing the latter tool, i.e., built-up tool, is explained.

The tool holder 12 is a table for fixing the cutting tool 11 thereto. The cutting tool 11 has been fixed to this tool holder 12, with the shank of the tool directed in a radial direction for the raw pipe 10.

The guide pipe 13 is a pipe for guiding chips which has been attached to a side surface of the tool holder 12. The intake of this guide pipe 13 has been disposed so as to face the tip 11A of the cutting tool 11, and the guide pipe 13 has been disposed so as to extend along the direction of chip flow.

The bed 14 is a basal part for supporting the components of the turning apparatus which are shown in FIG. 8. It is a pedestal having a flat top.

Furthermore, the slide stage 15 is a stage movably attached to the bed 14, and the tool holder 12 has been disposed on the upper side thereof. The slide stage 15 has such a constitution that it is movable in any desired directions along the top of the bed 14. Consequently, the tool holder 12 and the cutting tool 11 and guide pipe 13, which have been attached to the tool holder 12, can be moved with the movement of the slide stage 14.

The pair of heads 16 is a part for holding the raw pipe 10 attached over the bed 14. It has such a constitution that it rotates the raw pipe 10 while holding the ends of the raw pipe 10.

The turning apparatus shown in FIG. 8 has the constitution described above. When this turning apparatus is used, the following operation is conducted.

In rough turning, the raw pipe 10 is first set so as to be held by the heads 16. Subsequently, while the raw pipe 10 is being rotated by the heads 16, the slide stage 15 is moved to bring the tip 11A of the cutting tool 11 into contact with the surface of the raw pipe 10 and conduct rough turning. This rough turning is conducted for the purpose of eliminating the wall thickness unevenness and bending of the substrate. The shavings resulting from the turning are guided through the guide pipe 13 to a waste box not shown.

As a result of the turning with the cutting tool 11, grooves extending nearly in circumferential directions for the raw pipe 10 (hereinafter suitably referred to as "circumferential grooves") are formed in the surface of the raw pipe 10 along the directions of rotation.

Incidentally, the rough turning often results in the formation of turning burrs (projections) called "whiskers". In case where such whiskers remain, they are causative of leakage in image formation or cause black-spot defects in image formation through reversal development. It is therefore desirable to remove the whiskers beforehand.

Finish turning is hence generally conducted in order to remove the whiskers and improve the dimensional accuracy of the substrate. In the finish turning, the raw pipe 10 is held by the heads 16 and, while this raw pipe 10 is being rotated, the slide stage 15 is moved to bring the tip 11A of the cutting tool 11 into contact with the surface of the raw pipe 10 to conduct turning, as in the rough turning. However, in the finish turning, operational conditions are controlled so as to be suitable for the purpose. Specifically, turning conditions including the moving speed of the slide stage 15, revolution speed of the raw pipe 10, cutting amount for the cutting tool 11, and sliding speed of the cutting tool 11 are precisely controlled.

By thus conducting rough turning and finish turning, circumferential grooves suitable for substrate surface roughening are formed in the surface of the raw pipe 10. It should, however, be noted that since the circumferential grooves are straight and continuous and have exceedingly high regularity, they are less effective in inhibiting interference fringes as stated above.

Figure 9:
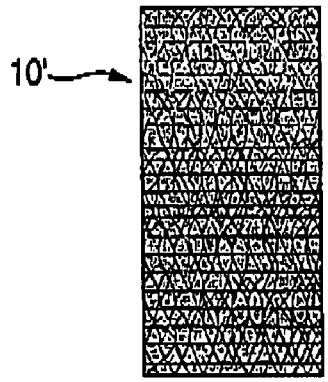
FIG. 9 is a diagrammatic view showing one example of groove shapes in an electrophotographic photoreceptor substrate of the invention which has been developed into a plane.

Arc grooves are hence formed, by the method described above, in the surface of the raw pipe 10 in which the circumferential grooves have been formed, whereby a substrate for electrophotographic photoreceptors is produced. Namely, a flexible material is brought into contact with the surface of the raw pipe 10 in which circumferential grooves have been formed, and is caused to travel on the surface thereof. As a result, the substrate surface comes to have arc grooves and the circumferential grooves as shown in FIG. 9. FIG. 9 is a diagrammatic view showing one example of the shapes of the grooves formed in the substrate surface which has been developed on a plane. The substrate surface developed on a plane is indicated by sign 10'.

By thus conducting rough turning and finish turning prior to the formation of arc grooves, the substrate surface is made to have a more complicated shape than in the case where circumferential grooves only are formed, whereby the regularity of the light reflected by the substrate surface can be further disordered. In addition, in contrast to the related-art technique in which the formation of circumferential grooves by turning has been less effective in inhibiting interference fringes because the grooves are straight and continuous and have exceedingly high regularity, the process described above, in which arc grooves are formed besides circumferential grooves, makes it possible to obtain the sufficient effect of inhibiting interference fringes.

(Case 2)

Use may be made of, for example, a method in which finish turning is conducted, without performing rough turning, prior to the formation of arc grooves as shown in FIG. 7(*b*). A drawn pipe or the like to which satisfactory accuracy has been imparted beforehand may be used here, or this processing is conducted for the purpose of attaining a reduction in turning cost. An explanation is given below in which a raw pipe is used as an example of the substrate in which arc grooves are to be formed.

The finish turning is conducted with, for example, the turning apparatus shown in FIG. 8. An explanation on the finish turning with the turning apparatus shown in FIG. 8 is omitted here because this machining has been explained in case 1.

By thus conducting finish turning, circumferential grooves extending nearly in circumferential directions for the raw pipe 10 are formed in the surface of the raw pipe 10. It is, however, noted that this finish turning should be conducted in an increased amount, as different from the finish turning performed in combination with rough turning. Because of this, projections called "whiskers" are often formed.

In case 1 described above, finish turning was conducted after rough turning in order to remove whiskers and improve substrate accuracy. In case 2, however, the raw pipe 10 which has undergone the finish turning is processed by the surface roughening method described above to thereby form arc grooves therein. Namely, a flexible material is brought into contact with the surface of the raw pipe 10 in which circumferential grooves have been formed, and is caused to travel on the surface thereof.

As a result, the whiskers formed on the surface of the raw pipe 10 are removed and an electrophotographic photoreceptor substrate having circumferential grooves and arc grooves formed in the surface thereof as shown in FIG. 9 can be obtained. The sufficient effect of inhibiting interference fringes can hence be obtained by this process also. Consequently, by thus conducting finish turning, without rough turning, prior to the formation of arc grooves, the substrate surface is made to have a more complicated shape than in the case where circumferential grooves only are formed, whereby the regularity of the light reflected by the substrate surface can be further disordered as in case 1.

In addition, the trouble of conducting rough turning can be eliminated in contrast to case 1, i.e., the case where rough turning and finish turning are conducted beforehand. Consequently, the time required for producing the substrate of the invention can be reduced.

(Case 3)

The surface of a substrate may be subjected, for example, to ironing prior to the formation of arc grooves as shown in FIG. 7(*c*).

Figure 10:
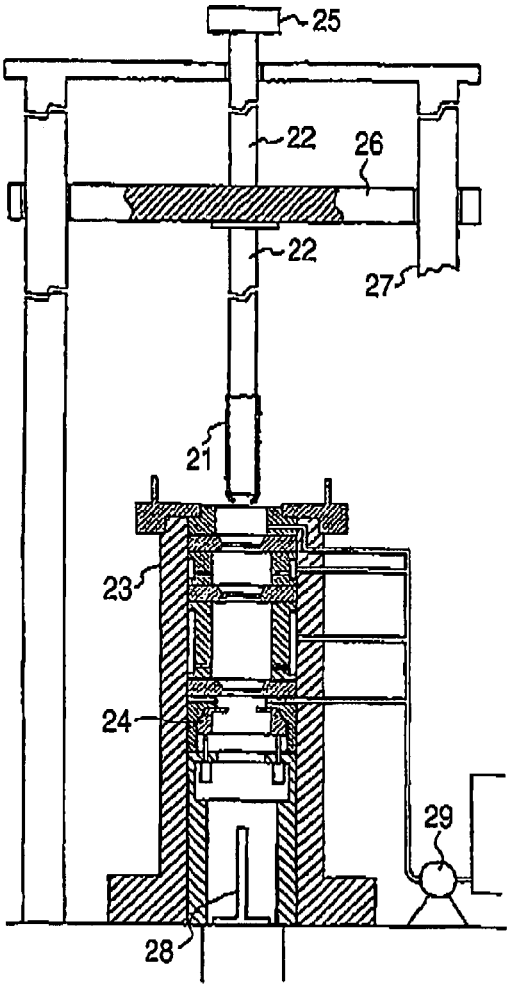
FIG. 10 is partly cutaway front views of an ironing apparatus for use in producing an electrophotographic photoreceptor substrate of the invention; (a) shows a state before ironing and (b) shows a state after ironing.
Figure 10:
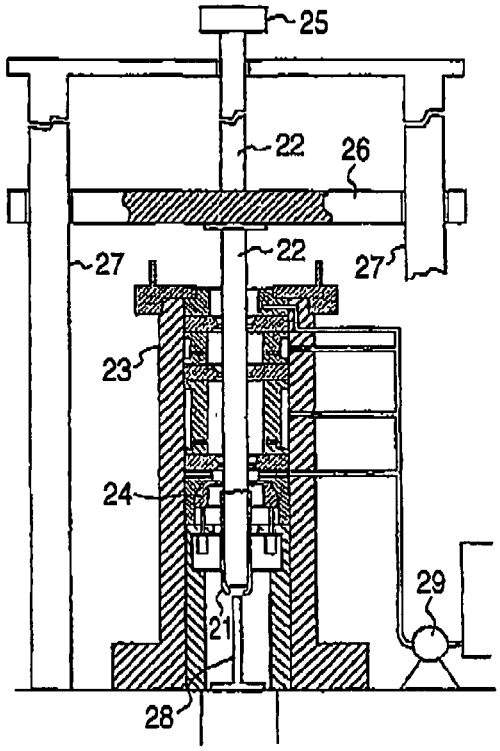

FIG. 10 is partly cutaway front views of an ironing apparatus for use in the ironing of an extruded pipe 21. FIG. 10(*a*) shows the ironing apparatus in which the extruded pipe 21 has been set in preparation for ironing, while FIG. 10(*b*) shows the whole apparatus after ironing in which claws 24 project for separating the extruded pipe 21 from a punch 22 in close contact with the pipe 21 and the punch 22 is in the state just before going up. One end of the extruded pipe 21 has a smaller inner diameter than the other parts of the pipe 21 so that the punch 22, which will be described later, can press the pipe from inside.

The ironing apparatus shown in FIG. 10 is an apparatus in which the cylindrical extruded pipe 21 is passed through dies to thereby conduct ironing. It comprises a punch 22, die holder 23, claws 24, hydraulic cylinder 25, punch holder plate 26, guide 27, jig 28, and pump 29.

The punch 22 is a pressing member which enters the extruded pipe 21 and presses the extruded pipe 21 into dies attached to the die holder 23.

The die holder 23 is a die-holding part in which dies have been disposed.

The claws 24 are claws for separating the extruded pipe 21 from the punch 22 after ironing.

The hydraulic cylinder 25 is a punch-driving part for lifting up and bringing down the punch 22 upward and downward in the figure.

The punch holder plate 26 is a punch-holding part for fixing the punch 22 thereto. It is capable of going up and going down along the guide 27, which will be described below, together with the punch 22 upward and downward in the figure.

The guide 27 is a guide part for guiding the punch holder plate 26 upward and downward in the figure. The jig 28 is a jig for receiving the extruded pipe 21 separated from the punch 22.

Furthermore, the pump 29 is a pump for supplying a lubricating oil during ironing to the parts which are being ironed. It can supply the lubricating oil to the dies held by the die holder 23, while circulating the oil.

The ironing apparatus shown in FIG. 10 has the constitution described above. When this ironing apparatus is used, the following operation is conducted.

In ironing, the pump 29 is first operated to circulate a lubricating oil through the dies. While the lubricating oil is being circulated, an extruded pipe 21 to be processed is attached to the punch 22. The punch 22 at this time is standby in the limit position above the die holder 23.

Subsequently, the valve of a hydraulic pump (not shown) for supplying a hydraulic pressure to the hydraulic cylinder 25 is switched to operate the hydraulic cylinder 25. The punch 22 goes down with the operation of the hydraulic cylinder 25. In this operation, the punch 22 goes down while pushing one end (the lower end in FIG. 10) of the extruded pipe 21 with its front end.

As the punch 22 goes down, the extruded pipe 21 passes through the dies attached to the die holder 23. When the extruded pipe 21 passes through the dies, it repeatedly undergoes ironing and is processed into a given size. Furthermore, as a result of the ironing, grooves extending in the axis direction for the extruded pipe 21 (hereinafter suitably referred to as "axial grooves") are formed.

After the extruded pipe 21 has passed all the dies, the claws 24 move forward to confine the other end (upper end) of the extruded pipe 21. Subsequently, the valve of the hydraulic pump operating the hydraulic cylinder 25 is switched, and the hydraulic cylinder 25 lifts up the punch 22. The extruded pipe 21 which has been pushed so as to be in close contact with the punch 22 is separated from the punch 22 by the claws 24, and is transferred to the jig 28. The punch 22 is returned to the limit position above the die holder 23.

As a result of the ironing thus conducted, the extruded pipe 21 is processed into a given size and axial grooves are formed. The pipe 21 comes to have a roughened surface due to the axial grooves. However, since the axial grooves are linearly and continuously formed along the axial direction for the extruded pipe 21, the grooves are highly regular and the surface roughening with the axial grooves only is less effective in inhibiting interference fringes.

Arc grooves are hence formed, by the method described above, in the extruded pipe 21 which has undergone ironing. Namely, a flexible material is brought into contact with the surface of the extruded pipe 21 in which axial grooves have been formed, and is caused to travel on the surface thereof.

Figure 11:
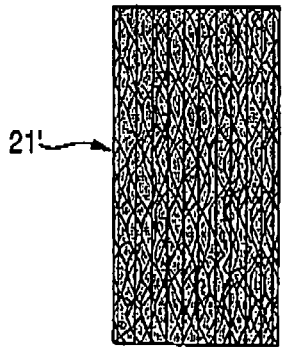
FIG. 11 is a diagrammatic view showing one example of groove shapes in an electrophotographic photoreceptor substrate of the invention which has been developed into a plane.

As a result, an electrophotographic photoreceptor substrate having arc grooves formed therein besides the axial grooves as shown in FIG. 11 can be obtained. Consequently, in contrast to the case where axial grooves are formed by ironing, in which the effect of inhibiting interference fringes is low because the grooves are straight and continuous and have exceedingly high regularity, the process described above makes it possible to obtain the sufficient effect of inhibiting interference fringes because arc grooves are formed besides the axial grooves. FIG. 11 is a diagrammatic view showing one example of the shapes of the grooves formed in the surface of the substrate obtained, the substrate surface having been developed on a plane. The substrate surface developed on a plane is indicated by sign 21'.

Furthermore, as a result of the formation of arc grooves by the surface roughening method described above, the values of Rz, Rku, groove width L, etc. of the axial grooves also come into preferred ranges. Consequently, by conducting ironing prior to the formation of arc grooves, the substrate surface is made to have a more complicated shape than in the case where axial grooves only are formed, whereby the regularity of the light reflected by the substrate surface can be further disordered.

In addition, forming by ironing is far superior in productivity to forming by turning. Consequently, by forming a substrate by ironing, the time required for producing the substrate of the invention can be considerably reduced as compared with the case where surface roughening or forming is conducted by turning as in cases 1 and 2.

Incidentally, the values of Rz, Rku, groove width L, etc. need not be always within the ranges shown above, as long as the surface of the substrate for use as an electrophotographic photoreceptor substrate has been sufficiently roughened.

(Electrophotographic Photoreceptor)

The electrophotographic photoreceptor substrate of the invention has specific arc grooves. Because of this, interference fringes, which are caused by the phenomenon in which a writing light is reflected by the substrate surface and interfaces between coating films and interferes to cause the light acting on the charge-generating layer to have unevenness in intensity due to slight differences in the thickness of each coating film, are eliminated by imparting irregularity to exposure light reflection by the substrate surface.

Consequently, the photosensitive layer of the electrophotographic photoreceptor, which employs the electrophotographic photoreceptor substrate of the invention, can have any of the known constitutions for general use in electrophotographic photoreceptors. For example, a photosensitive layer of the so-called multilayer type comprising superposed layers comprising a charge-generating layer containing a charge-generating material and a charge-transporting layer containing a charge-transporting material is applicable besides a single-layer photosensitive layer of the so-called dispersion type comprising a charge-transporting medium containing a charge-transporting material and particles of a charge-generating material dispersed therein. Various photoreceptors of the multilayer type are known which include ones comprising a charge-generating layer and a charge-transporting layer which have been superposed in this order on a substrate (hereinafter sometimes referred to as photosensitive layers of the right-order superposition multilayer type) and ones comprising these layers superposed in the reversed order (hereinafter sometimes referred to as photosensitive layers of the reversed-order superposition multilayer type). The photosensitive layer of the electrophotographic photoreceptor of the invention can have any of these constitutions.

With respect to exposure light sources, lights in general wide use which have a relatively long wavelength of 700-850 nm and lights having a relatively short wavelength of 350-500 nm are usable of course. The substrate of the invention is applicable to all electrophotographic photoreceptors in which interference fringes are problematic, irrespective of wavelength.

(Charge-Generating Material)

Any desired charge-generating material may be used in the electrophotographic photosensitive layer in the invention which contains a charge-transporting material. For example, inorganic photoconductive particles such as selenium, selenium-tellurium alloys, selenium-arsenic alloys, cadmium sulfide, and amorphous silicon and various organic pigments and dyes such as metal-free phthalocyanine, metal-containing phthalocyanines, perinone pigments, indigo, thioindigo, quinacridone, perylene pigments, anthraquinone pigments, azo pigments, bisazo pigments, trisazo pigments, tetrakisazo pigments, cyanine pigments, polycyclic quinone pigments, pyrylium salts, thiopyrylium salts, anthanthrone, and pyranthrone can be used. One charge-generating material may be used alone, or any desired combination of two or more charge-generating materials may be used in any desired proportion.

Preferred of those from the standpoint of obtaining a photoreceptor having high sensitivity are metal-free phthalocyanine, phthalocyanines having coordinated thereto a metal or metal oxide or chloride, such as copper, indium chloride, gallium chloride, tin, oxytitanium, zinc, or vanadium, and azo pigments such as monoazo, bisazo, trisazo, and polyazo compounds.

Of those charge-generating materials, metal-free phthalocyanine and the metal-containing phthalocyanines are superior in giving a photoreceptor having high sensitivity to laser lights having a relatively long wavelength. Furthermore, azo pigments such as monoazo, bisazo, and trisazo compounds are superior in having sufficient sensitivity to white light and laser lights having a relatively short wavelength.

Especially preferred of the phthalocyanines are oxytitanium phthalocyanine showing a main diffraction peak at a Bragg angle ($2\theta \pm 0.2°$) of 27.3° in an X-ray diffraction spectrum obtained with $CuK_\alpha$ characteristic X-ray, oxytitanium phthalocyanine showing main diffraction peaks at Bragg angles of 9.3°, 13.2°, 26.2°, and 27.1°, dihydroxysilicon phthalocyanine showing main diffraction peaks of Bragg angles of 9.2°, 14.1°, 15.3°, 19.7°, and 27.1°, dichlorotin phthalocyanine showing main diffraction peaks at Bragg angles of 8.5°, 12.2°, 13.8°, 16.9°, 22.4°, 28.4°, and 30.1°, hydroxygallium phthalocyanine showing main diffraction peaks at Bragg angles of 7.5°, 9.9°, 12.5°, 16.3°, 18.6°, 25.1°, and 28.3°, and chlorogallium phthalocyanine showing diffraction peaks at Bragg angles of 7.4°, 16.6°, 25.5°, and 28.3°.

In the case of a dispersion type photosensitive layer, the particle diameter of the charge-generating material should be sufficiently small. The particle diameter of the charge-generating material to be used is preferably 1 μm or smaller, more preferably 0.5 μm or smaller. The amount of the charge-generating material to be dispersed in the dispersion type photosensitive layer is in the range of, for example, 0.5-50% by weight. In case where the amount thereof is too small, sufficient sensitivity cannot be obtained. Too large amounts thereof exert adverse influences such as a decrease in charge acceptance and a decrease in sensitivity. More preferably, the charge-generating material is used in an amount in the range of 1-20% by weight. The thickness of the dispersion type photosensitive layer to be used is generally 5-50 μm, more preferably 10-45 μm.

(Charge-Generating Layer)

The charge-generating material is dissolved or dispersed in a solvent together with a binder polymer (binder resin) and optionally further with other organic photoconductive compounds, colorants, electron-attracting compounds, etc. The coating fluid obtained is applied on the substrate and dried to obtain a charge-generating layer.

The dyes/pigments which may be optionally added to the charge-generating layer in the invention are not particularly limited, and examples thereof include triphenylmethane dyes such as Methyl Violet, Brilliant Green, and Crystal Violet, thiazine dyes such as Methylene Blue, quinine dyes such as quinizarin, cyanine dyes, byrylium salts, thiabyrylium salts, and benzobyrylium salts. The electron-attracting compounds, which form charge-transfer complexes with arylamine compounds, also are not particularly limited. Examples thereof include electron-attracting compounds such as quinines such as chloranil, 2,3-dichloro-1,4-naphthoquinone, 1-nitroanthraquinone, 1-chloro-5-nitroanthraquinone, 2-chloroanthraquinone, and phenanthrenequinone; aldehydes such as 4-nitrobenzaldehyde; ketones such as 9-benzoylanthracene, indanedione, 3,5-dinitrobenzophenone, 2,4,7-trinitrofluorenone, 2,4,5,7-tetranitrofluorenone, and 3,3',5,5'-tetranitrobenzophenone; acid anhydrides such as phthalic anhydride and 4-chloronaphthalic anhydride; cyano compounds such as tetracyanoethylene, terephthalylmalononitrile, 9-anthrylmethylidenemalononitrile, 4-nitrobenzalmalononitrile, and 4-(p-nitrobenzoyloxy) benzalmalononitrile; and phthalide compounds such as 3-benzalphthalide, 3-(α-cyano-p-nitrobenzal)phthalide, and 3-(α-cyano-p-nitrobenzal)-4,5,6,7-tetrachlorophthalide. One of those organic photoconductive compounds, colorants, electron-attracting compounds, and the like may be used alone, or any desired combination of two or more thereof may be used in any desired proportion.

The charge-generating layer may be used in the form obtained by binding the material with any of various binder resins such as, e.g., polyester resins, poly(vinyl acetate), polyesters, polycarbonates, poly(vinyl acetoacetal), poly(vinyl propional), poly(vinyl butyral), phenoxy resins, epoxy resins, urethane resins, cellulose esters, and cellulose ethers. Examples of the binder resins further include polymers and copolymers of vinyl compounds such as styrene, vinyl acetate, vinyl chloride, acrylic esters, methacrylic esters, vinyl alcohol, and ethyl vinyl ether, polyamides, and silicon resins.

The proportion of the charge-generating material to be used in this case is in the range of generally 20-2,000 parts by weight, preferably 30-500 parts by weight, more preferably 33-500 parts by weight, per 100 parts by weight of the binder resin. The thickness of the charge-generating layer desirably is generally 0.05-5 μm, preferably 0.1 μm to 2 μm, more preferably 0.15 μm to 0.8 μm. The charge-generating layer may be a film of the charge-generating material formed by vapor deposition.

(Charge-Transporting Material)

There are no particular limitations on the charge-transporting material, and known ones can be used at will. Examples thereof include electron-attracting substances such as aromatic nitro compounds such as 2,4,7-trinitrofluorenone, cyano compounds such as tetracyanoquinodimetan, and quinones such as diphenoquinone; and electron-donating substances such as heterocyclic compounds such as carbazole derivatives, indole derivatives, imidazole derivatives, oxazole derivatives, pyrazole derivatives, oxadiazole derivatives, pyrazoline derivatives, and thiadiazole derivatives, aniline derivatives, hydrazone compounds, aromatic amine compounds, stilbene derivatives, butadiene derivatives, enamine compounds, compounds made up of two or more of these compounds bonded to each other, and polymers having groups derived from any of these compounds in the main chain or side chains thereof. Preferred of these are carbazole derivatives, hydrazone derivatives, aromatic amine derivatives, stilbene derivatives, butadiene derivatives, and compounds made up of two or more of these derivatives bonded to each other. Especially preferred are compounds made up of two or more of aromatic amine derivatives, stilbene derivatives, and butadiene derivatives bonded to each other. One of such charge-transporting materials may be used alone, or any desired combination of two or more thereof may be used in any desired proportion.

(Binder Resin)

The binder resin to be used in the charge-transporting layer in the case of a multilayered photosensitive layer or the binder resin to be used as a matrix in the case of a dispersion type photosensitive layer is not particularly limited. It is, however, preferred to use a polymer which has satisfactory compatibility with the charge-transporting material and gives a coating film in which the charge-transporting material neither crystallizes nor undergoes phase separation. Examples thereof include various polymers such as polymers and copolymers of vinyl compounds such as styrene, vinyl acetate, vinyl chloride, acrylic esters, methacrylic esters, and butadiene, poly(vinyl acetal), polycarbonates, polyesters, polyester carbonates, polysulfones, polyimides, poly(phenyleneoxide), polyurethanes, cellulose esters, cellulose ethers, phenoxy resins, silicon resins, and epoxy resins. Products of the partial crosslinking/curing of these polymers are also usable. One binder resin may be used alone, or any desired combination of two or more binder resins may be used in any desired proportion.

Larger binder amounts bring about a higher mechanical strength of the layer and are preferred in this point. However, larger binder amounts result in a relatively reduced arylamine compound content and hence in impaired electrophotographic properties. Consequently, the amount of the binder to be used is generally at least 0.5 times by weight, preferably at least 0.7 times by weight, especially preferably at least 0.9 times by weight the amount of the arylamine compound and is generally up to 30 times by weight, preferably up to 10 times by weight, especially preferably up to 8 times by weight the amount of the arylamine compound.

(Charge-Transporting Layer)

The charge-transporting materials to be incorporated into the charge-transporting layer of a multilayered photosensitive layer may be used alone, or a mixture of any desired combination of two or more thereof in any desired proportion may be used. In the case of a multilayered photosensitive-layer, a charge-transporting layer is generally formed in which any of those charge-transporting materials has been bound to the binder resin. The charge-transporting layer may consist of a single layer or may be composed of superposed layers differing in component or composition.

The proportion of the binder resin to the charge-transporting material is as follows. Since too small proportions of the charge-transporting material to the binder resin result in impaired electrophotographic properties, the charge-transporting material is generally used in an amount of 30 parts by weight or larger, preferably 40 parts by weight or larger, based on the binder resin. On the other hand, since too large proportions of the charge-transporting material to the binder resin result in a charge-transporting layer having reduced mechanical strength, the charge-transporting material is generally used in an amount of up to 200 parts by weight, preferably up to 150 parts by weight, per 100 parts by weight of the binder resin.

The thickness of the charge-transporting layer to be used is generally 10-60 μm, preferably 10-45 μm, more preferably 15-40 μm.

(Additives)

The photosensitive layer of the electrophotographic photoreceptor of the invention may contain additives such as known plasticizers and crosslinking agents for improving film-forming properties, flexibility, and mechanical strength, antioxidants, stabilizers, sensitizers, and various leveling agents and dispersants for improving applicability. Examples of the plasticizers include phthalic esters, phosphoric esters, epoxy compounds, chlorinated paraffins, chlorinated fatty acid esters, and aromatic compounds such as methylnaphthalene. Examples of the leveling agents include silicone oils and fluorochemical oils. Examples of the antioxidants include hindered phenol compounds, hindered amine compounds, and benzylamine compounds.

(Other Functional Layers)

It is a matter of course that the photoreceptor thus formed may have a layer for improving electrophotographic properties or mechanical properties according to need, such as an interlayer, e.g., a barrier layer, adhesive layer, or blocking layer, a transparent insulating layer, or a protective layer.

A known overcoat layer made mainly of, e.g., a thermoplastic resin or thermoset resin may be formed as an outermost layer.

(Solvent)

The solvent to be used for preparing the coating fluid is not particularly limited. Examples thereof include solvents in which the arylamine compound can be dissolved. Such solvents include ethers such as tetrahydrofuran and 1,4-dioxane; ketones such as methyl ethyl ketone and cyclohexanone; aromatic hydrocarbons such as toluene and xylene; aprotic polar solvents such as N,N-dimethylformamide, acetonitrile, N-methylpyrrolidone, and dimethyl sulfoxide; esters such as ethyl acetate, methyl formate, and methyl Cellosolve acetate; and chlorinated hydrocarbons such as dichloroethane and chloroform. It is, of course, necessary that a solvent in which the binder can be dissolved should be selected from these. Such solvents for coating fluid preparation may be used alone, or any desired combination of two or more of these may be used in any desired proportion.

(Layer Formation Method)

For coating for forming a photosensitive layer, any of known techniques such as spray coating, spiral coating, ring coating, and dip coating can be used. In general, however, dip coating is used.

Techniques of the spray coating include air spraying, airless spraying, electrostatic air spraying, electrostatic airless spraying, electrostatic rotary spraying, hot spraying, and hot airless spraying. However, from the standpoint of the degree of particle size reduction, efficiency of adhesion, etc. which are necessary for obtaining an even film thickness, it is preferred to use electrostatic rotary spraying in which the conveying method disclosed in Domestic Re-publication of PCT Patent Application No. 1-805198, i.e., the method in which cylindrical works are successively conveyed with rotation without forming a space between adjacent works in the axis direction, is used. By this spraying, an electrophotographic photoreceptor having excellent film thickness evenness can be obtained while attaining a high overall efficiency of adhesion.

Examples of the spiral coating include the method disclosed in JP-A-52-119651 in which a cast coater or curtain coater is used, the method disclosed in JP-A-1-231966 in which a coating fluid is flown in the form of a continuous line from a minute opening, and the method disclosed in JP-A-3-193161 which employs a multinozzle.

Thereafter, the coating film is dried. It is preferred to regulate the drying temperature and time so as to conduct necessary and sufficient drying. The drying temperature is in the range of generally 100-250° C., preferably 110-170° C., more preferably 120-140° C. For the drying can be used a hot-air dryer, steam dryer, infrared dryer, far-infrared dryer, or the like.

(Image-Forming Apparatus)

An embodiment of the image-forming apparatus employing the electrophotographic photoreceptor of the invention (image-forming apparatus of the invention) will be explained below by reference to FIG. 12, which shows the constitutions of important parts of the apparatus. However, embodiments should not be construed as being limited to the following explanation, and the invention can be practiced with any desired modifications unless these modifications depart from the spirit of the invention.

Figure 12:
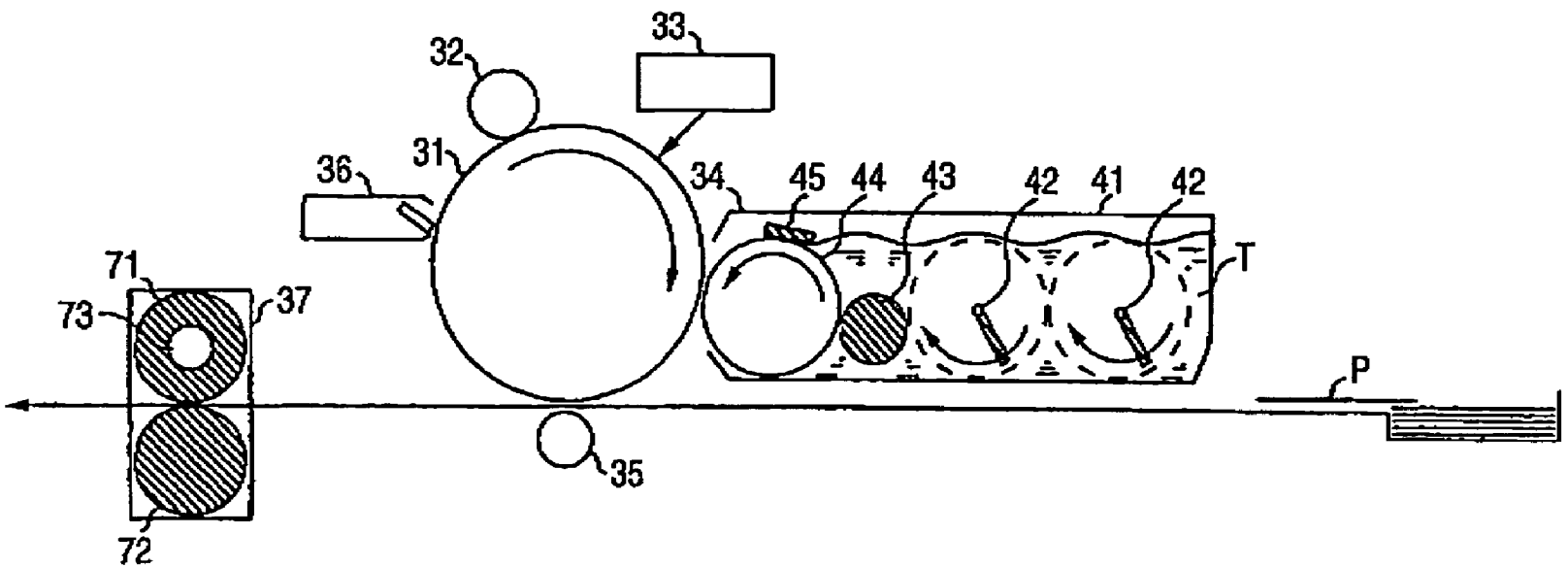
FIG. 12 is a diagrammatic view showing the constitutions of important parts of an image-forming apparatus of the invention.

As shown in FIG. 12, the image-forming apparatus comprises an electrophotographic photoreceptor 31, a charging device 32, an exposure device 33, and a developing device 34. According to need, a transfer device 35, a cleaner 36, and a fixing device 37 are further disposed.

The electrophotographic photoreceptor 31 is not particularly limited as long as it is the electrophotographic photoreceptor of the invention described above. FIG. 12 shows, as an example thereof, a drum-shaped photoreceptor comprising a cylindrical electro conductive substrate and, formed on the surface thereof, the photosensitive layer described above. The charging device 32, exposure device 33, developing device 34, transfer device 35, and cleaner 36 are disposed along the peripheral surface of this electrophotographic photoreceptor 31.

The charging device 32 serves to charge the electrophotographic photoreceptor 31. It evenly charges the surface of the electrophotographic photoreceptor 31 to a given potential. As the charging device is frequently used: a corona charging device such as a corotron or scorotron; a direct-charging device in which a direct-charging member to which a voltage is applied is brought into contact with the photoreceptor surface to charge it (contact type charging device); a contact type charging device such as a charging brush; or the like. Examples of the direct-charging device include contact charging devices such as charging rollers and charging brushes. FIG. 12 shows a roller type charging device (charging roller) as an example of the charging device 32. For the direct charging can be used either of charging which is accompanied by an aerial discharge and injection charging which is not accompanied by an aerial discharge. As the voltage to be applied for charging can be used a direct-current voltage alone or a voltage obtained with a direct current and an alternating current superimposed thereon.

The exposure device 33 is not particularly limited in kind as long as it can illuminate the electrophotographic photoreceptor 31 and thereby form an electrostatic latent image in the photosensitive surface of the electrophotographic photoreceptor 31. Examples thereof include halogen lamps, fluorescent lamps, lasers such as semiconductor lasers and He—Ne lasers, and LEDs. It is also possible to conduct exposure by the technique of internal photoreceptor exposure. Any desired light can be used for exposure. For example, the monochromatic light having a wavelength of 780 nm, a monochromatic light having a slightly short wavelength of from 600 nm to 700 nm, a monochromatic light having a short wavelength of from 380 nm to 500 nm, or the like may be used to conduct exposure.

The developing device 34 is not particularly limited in kind, and any desired device can be used, such as one operated by a dry development technique, e.g., cascade development, development with a one-component insulating toner, development with a one-component conductive toner, or two-component magnetic brush development, a liquid development technique, etc. In FIG. 12, the developing device 34 comprises a developing chamber 41, agitators 42, a feed roller 43, a developing roller 44, and a control member 45. This device has such a constitution that a toner T is stored in the developing chamber 41. According to need, the developing device 34 may be equipped with a replenishing device (not shown) for replenishing the toner T. This replenishing device has such a constitution that the toner T can be supplied from a container such as a bottle or cartridge.

The feed roller 43 is made of an electrically conductive sponge, etc. The developing roller 44 comprises a metallic roll made of iron, stainless steel, aluminum, nickel, or the like, a resinous roll obtained by coating such a metallic roll with a resin such as a silicone resin, urethane resin, or fluororesin, or the like. The surface of this developing roller 44 may be subjected to a surface-smoothing processing or surface-roughening processing according to need.

The developing roller 44 is disposed between the electrophotographic photoreceptor 31 and the feed roller 43 and is in contact with each of the electrophotographic photoreceptor 31 and the feed roller 43. The feed roller 43 and the developing roller 44 are rotated by a rotation driving mechanism (not shown). The feed roller 43 holds the toner T stored and supplies it to the developing roller 44. The developing roller 44 holds the toner T supplied by the feed roller 43 and brings it into contact with the surface of the electrophotographic photoreceptor 31.

The control member 45 comprises a resinous blade made of a silicone resin, urethane resin, or the like, a metallic blade made of stainless steel, aluminum, copper, brass, phosphor bronze, or the like, a blade obtained by coating such a metallic blade with a resin, etc. This control member 45 is in contact with the developing roller 44 and is pushed against the developing roller 44 with a spring or the like at a given force (the linear blade pressure is generally 5-500 g/cm). According to need, this control member 45 may have the function of charging the toner T based on electrification by friction with the toner T.

The agitators 42 each are rotated by the rotation driving mechanism. They agitate the toner T and convey the toner T to the feed roller 43 side. Two or more agitators 42 differing in blade shape, size, etc. may be disposed.

The transfer device 35 is not particularly limited in kind, and use can be made of a device operated by any desired technique selected from an electrostatic transfer technique, pressure transfer technique, adhesive transfer technique, and the like, such as corona transfer, roller transfer, and belt transfer. Here, the transfer device 35 is one constituted of a transfer charger, transfer roller, transfer belt, or the like disposed so as to face the electrophotographic photoreceptor 31. A given voltage (transfer voltage) which has the polarity opposite to that of the charge potential of the toner T is applied to the transfer device 35, and this transfer device 35 thus transfers the toner image formed on the electrophotographic photoreceptor 31 to are cording paper (paper or medium) P.

The cleaner 36 is not particularly limited, and any desired cleaner can be used, such as a brush cleaner, magnetic brush cleaner, electrostatic brush cleaner, magnetic roller cleaner, or blade cleaner. The cleaner 36 serves to scrape off the residual toner adherent to the photoreceptor 31 with a cleaning member and thus recover the residual toner.

The fixing device 37 is constituted of an upper fixing member (fixing roller) 71 and a lower fixing member (fixing roller) 72. The fixing member 71 or 72 is equipped with a heater 73 inside. FIG. 12 shows an example in which the upper fixing member 71 is equipped with a heater 73 inside. As the upper and lower fixing members 71 and 72 can be used a known heat-fixing member such as a fixing roll comprising a metallic raw tube made of stainless steel, aluminum, or the like and a silicone rubber with which the tube is coated, a fixing roll obtained by further coating the fixing roll with a fluororesin, or a fixing sheet. Furthermore, the fixing members 71 and 72 each may have a constitution in which a release agent such as a silicone oil is supplied thereto in order to improve release properties, or may have a constitution in which the two members are forcedly pressed against each other with a spring or the like.

The toner which has been transferred to the recording paper P passes through the nip between the upper fixing member 71 heated at a given temperature and the lower fixing member 72, during which the toner is heated to a molten state. After the passing, the toner is cooled and fixed to the recording paper P.

The fixing device also is not particularly limited in kind. Fixing devices which can be mounted include a fixing device operated by any desired fixing technique, such as heated-roller fixing, flash fixing, oven fixing, or pressure fixing, besides the device used here.

In the electrophotographic apparatus having the constitution described above, image recording is conducted in the following manner. First, the surface (photosensitive surface) of the photoreceptor 31 is charged to a given potential (e.g., −600 V) with the charging device 32. This charging may be conducted with a direct-current voltage or with a direct-current voltage on which an alternating-current voltage has been superimposed.

Subsequently, the charged photosensitive surface of the photoreceptor 31 is exposed with the exposure device 33 according to the image to be recorded. Thus, an electrostatic latent image is formed in the photosensitive surface. This electrostatic latent image formed in the photosensitive surface of the photoreceptor 31 is developed by the developing device 34.

In the developing device 34, the toner T fed by the feed roller 43 is formed into a thin layer with the control member (developing blade) 45 and, simultaneously therewith, frictionally charged so as to have a given polarity (here, the toner is charged so as to have negative polarity, which is the same as the polarity of the charge potential of the photoreceptor 31). This toner T is conveyed while being held by the developing roller 44 and is brought into contact with the surface of the photoreceptor 31.

When the charged toner T held on the developing roller 44 comes into contact with the surface of the photoreceptor 31, a toner image corresponding to the electrostatic latent image is formed on the photosensitive surface of the photoreceptor 31. This toner image is transferred to a recording paper P with the transfer device 35. Thereafter, the toner which has not been transferred and remains on the photosensitive surface of the photoreceptor 31 is removed with the cleaner 36.

After the transfer of the toner image to the recording paper P, the recording paper P is passed through the fixing device 37 to thermally fix the tone image to the recording paper P. Thus, a finished image is obtained.

Incidentally, the image-forming apparatus may have a constitution in which an erase step, for example, can be conducted, in addition to the constitution described above. The erase step is a step in which the electrophotographic photoreceptor is exposed to a light to thereby erase the residual charges from the electrophotographic photoreceptor. As an eraser is used a fluorescent lamp, LED, or the like. The light to be used in the erase step, in many cases, is a light having such an intensity that the exposure energy thereof is at least 3 times the energy of the exposure light.

The constitution of the image-forming apparatus may be further modified. For example, the apparatus may have a constitution in which steps such as a pre-exposure step and an auxiliary charging step can be conducted, or have a constitution in which offset printing is conducted. Furthermore, the apparatus may have a full-color tandem constitution employing two or more toners.

The electrophotographic photoreceptor 31 may be combined with one or more of the charging device 32, exposure device 33, developing device 34, transfer device 35, cleaner 36, and fixing device 37 to constitute an integrated cartridge (hereinafter suitably referred to as "electrophotographic photoreceptor cartridge"). This electrophotographic photoreceptor cartridge may be made to have a constitution which makes the cartridge removable from the main body of an electrophotographic apparatus, e.g., a copier or laser beam printer. In this case, when, for example, the electrophotographic photoreceptor 1 or another member has deteriorated, this electrophotographic photoreceptor cartridge can be removed from the main body of the image-forming apparatus and a fresh electrophotographic photoreceptor cartridge can be mounted on the main body of the image-forming apparatus. Consequently, the maintenance/control of the image-forming apparatus is easy.

EXAMPLES

The invention will be explained below in more detail by reference to Examples, but the invention should not be construed as being limited to the following Examples.

Example 1

A brush obtained by processing a cylindrical support made of PVC having an outer diameter Φ of 60 mm to form holes having a diameter Φ of 5 mm in zigzag arrangement at a hole-to-hole interval of 10 mm and setting thereinto a nylon material ("Sungrid" manufactured by Asahi Chemical Industry Co., Ltd.) having a diameter Φ of 0.3 mm and containing abrasive alumina grains having a particle size of #1500 (average particle diameter, 10 μm) so as to result in a bristle length of 25 mm was used to conduct the surface-roughening processing of a mirror-surface turned pipe made of A3003 having dimensions of outer diameter Φ30 mm×length 346 mm×thickness 1.0 mm (the same pipe as in Comparative Example 4 given later). This processing was conducted under the conditions of a substrate revolution speed of 250 rpm, brush revolution speed of 750 rpm, overlap depth of 6 mm, lifting rate of 3 mm/sec, and water sprinkling amount of 1 L/min. This lifting rate was set at a highest possible value which did not result in the formation of grooves scatteringly distributed. The brush and the drum were disposed so that the angle between the respective axes of rotation thereof was 90° as shown in FIG. 1.

Subsequently, the pipe which had undergone the surface roughening was cleaned. First, the pipe was immersed for 5 minutes in a 60° C. liquid containing degreasing agent "NG-30", manufactured by Kizai Corp., dissolved therein in a concentration of 4% by weight, and then immersed successively in three pure-water baths of ordinary temperature for 1 minute each to thereby remove the degreasing agent.

Thereafter, the pipe was immersed in 82° C. pure water for 10 seconds, pulled out thereof at a rate of 10 mm/sec, and dried. Finally, this pipe was subjected to 10-minute finish drying in a 150° C. clean oven and allowed to cool to room temperature. As a result, curved and discontinuous grooves distributed in oblique lattice pattern arrangement such as those shown in FIG. 3 were formed in the substrate surface.

Part of the pipes thus formed was put aside as a sample to be examined for surface roughness and groove width. On another of the pipes which had undergone the cleaning, a photosensitive layer was formed in the following manner.

[Coating Fluid for Undercoat Layer]

The copolyamide shown below (number-average molecular weight, 35,000) was dissolved in a mixed alcohol (methanol/n-propanol=7/3) solution at 60-65° C. for 3 hours with stirring. Subsequently, the resultant solution was heated at 68-73° C. for 30 minutes. The solution which had been thus treated was mixed, by means of a homomixer, with a mixed alcohol (methanol/n-propanol=7/3) solution containing alumina [UA-5305, manufactured by Showa Denko K.K.] dispersed therein beforehand with ultrasonic. This mixture was stirred at 68-73° C. for 1 hour. Thereafter, the mixture was filtered and then subjected to a dispersion treatment with ultrasonic for 2 hours. Thus, a coating fluid for undercoat layer formation was produced which had a UA-5305/copolyamide proportion of 1/1 (by weight) and a solid concentration of 8%.

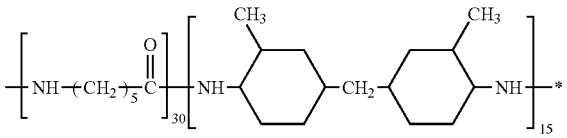

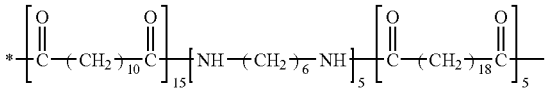

[Coating Fluid for Charge-Generating Layer]

To 10 parts of Y-form oxytitanium phthalocyanine and 5 parts of poly(vinylbutyral) (tradename, #6000-C; manufactured by Denki Kagaku Kogyo K.K.) was added 500 parts of 1,2-dimethoxyethane. This mixture was subjected to a pulverization/dispersion treatment with a sand grinding mill to obtain a coating fluid for charge-generating layer formation.

[Coating Fluid for Charge-Transporting Layer] In a 1,4-dioxane/tetrahydrofuran mixed solvent were dissolved 56 parts by weight of the hydrazone compound shown below,

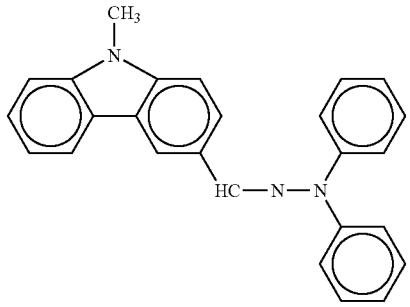

14 parts by weight of the hydrazone compound shown below,

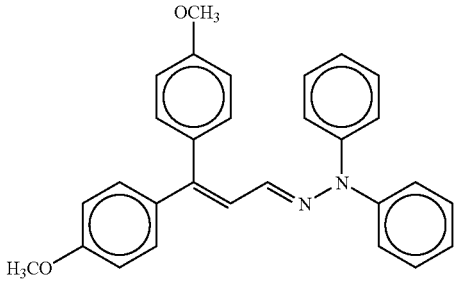

1.5 parts by weight of the following cyan compound,

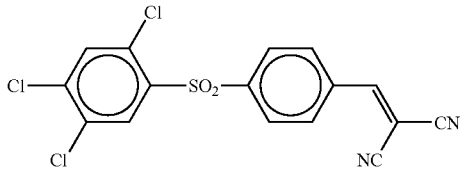

and 100 parts by weight of the following polycarbonate resin (monomer ratio by mole, 1:1).

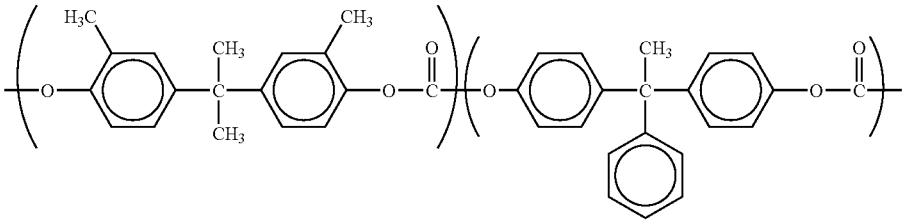

Thus, a coating fluid for charge-transporting layer formation was produced.

[Application]

The coating fluids described above were used to form an undercoat layer, charge-generating layer, and charge-transporting layer in this order through application by dip coating and drying. Thus, a multilayered photosensitive layer was formed. The undercoat layer, charge-generating layer, and charge-transporting layer were formed so as to have thicknesses of 1.25 μm, 0.5 μm, and 20 μm, respectively.

A flange member for driving was attached to the photoreceptor thus obtained, and this photoreceptor was incorporated into a cartridge for monochromatic laser beam printer LBP-850, manufactured by Canon Inc. Images were formed and visually evaluated.

Example 2

A nylon material ("Sungrid" manufactured by Asahi Chemical Industry Co., Ltd.) having a diameter Φ of 0.3 mm and containing abrasive alumina grains having a particle size of #1000 (average particle diameter, 16 μm) was used as bristles. A surface roughening processing was conducted under the conditions of a substrate revolution speed of 300 rpm, brush revolution speed of 100 rpm, overlap depth of 3 mm, lifting rate of 1 mm/sec, and water sprinkling amount of 1 L/min. Thus, curved and discontinuous oblique grooves such as those shown in FIG. 2 were formed in the substrate surface. Images were formed in the same manner as in Example 1, except that this substrate was used. The images were evaluated.

Example 3

The bristles used in Example 2 were used. The conditions included a substrate revolution speed of 250 rpm, brush revolution speed of 750 rpm, overlap depth of 6 mm, lifting rate of 5 mm/sec, and water sprinkling amount of 1 L/min. Thus, curved and discontinuous grooves distributed in oblique lattice pattern arrangement such as those shown in FIG. 3 were formed. Images were formed in the same manner as in Example 1, except that this substrate was used. The images were evaluated.

Example 4

A nylon material ("Toraygrid" manufactured by Toray Monofilament Co., Ltd.) having a diameter Φ of 0.4 mm and containing abrasive alumina grains having a particle size of #800 (average particle diameter, 20 μm) was used as bristles. A surface roughening processing was conducted under the conditions of a substrate revolution speed of 250 rpm, brush revolution speed of 750 rpm, overlap depth of 6 mm, lifting rate of 8 mm/sec, and water sprinkling amount of 1 L/min. Thus, curved and discontinuous grooves distributed in oblique lattice pattern arrangement such as those shown in FIG. 3 were formed in the substrate surface. Images were formed in the same manner as in Example 1, except that this substrate was used. The images were evaluated.

Example 5

A nylon material ("Sungrid" manufactured by Asahi Chemical Industry Co., Ltd.) having a diameter Φ of 0.3 mm and containing abrasive alumina grains having a particle size of #500 (average particle diameter, 34 μm) was used as bristles. A surface roughening processing was conducted under the conditions of a substrate revolution speed of 250 rpm, brush revolution speed of 750 rpm, overlap depth of 6 mm, lifting rate of 5 mm/sec, and water sprinkling amount of 1 L/min. Thus, curved and discontinuous grooves distributed in oblique lattice pattern arrangement such as those shown in FIG. 3 were formed in the substrate surface. Images were formed in the same manner as in Example 1, except that this substrate was used. The images were evaluated.

Example 6

A nylon material ("TYNEX A" manufactured by Du Pont) having a diameter Φ of 0.45 mm and containing abrasive alumina grains having a particle size of #500 (average particle diameter, 34 μm) was used as bristles. A surface roughening processing was conducted under the conditions of a substrate revolution speed of 250 rpm, brush revolution speed of 750 rpm, overlap depth of 6 mm, lifting rate of 10 mm/sec, and water sprinkling amount of 1 L/min. Thus, curved and discontinuous grooves distributed in oblique lattice pattern arrangement such as those shown in FIG. 3 were formed in the substrate surface. Images were formed in the same manner as in Example 1, except that this substrate was used. The images were evaluated.

Example 7

A nylon material ("TYNEX A" manufactured by Du Pont) having a diameter Φ of 0.55 mm and containing abrasive alumina grains having a particle size of #320 (average particle diameter, 48 μm) was used as bristles. A surface roughening processing was conducted under the conditions of a substrate revolution speed of 250 rpm, brush revolution speed of 750 rpm, overlap depth of 6 mm, lifting rate of 8 mm/sec, and water sprinkling amount of 1 L/min. Thus, curved and discontinuous grooves distributed in oblique lattice pattern arrangement such as those shown in FIG. 3 were formed in the substrate surface. Images were formed in the same manner as in Example 1, except that this substrate was used. The images were evaluated.

Comparative Example 1

An ironed pipe was used as it was without being subjected to a surface-roughening treatment. The same evaluation as in Example 1 was conducted.

Comparative Example 2

Use was made of a mirror-surface machined pipe obtained by turning an A3003 drawn pipe with a single-crystal diamond cutting tool so as to result in an arithmetic average roughness Ra of 0.03 μm and a maximum height Ry of 0.2 μm. The same evaluation as in Example 1 was conducted.

Comparative Example 3

Use was made of a mirror-surface machined pipe obtained by turning an A3003 drawn pipe with a polycrystalline diamond cutting tool so as to result in an arithmetic average roughness Ra of 0.07 μm and a maximum height Ry of 0.6 μm. The same evaluation as in Example 1 was conducted.

Comparative Example 4

Use was made of a mirror-surface machined pipe obtained by turning an A3003 drawn pipe with a polycrystalline diamond cutting tool so as to result in an arithmetic average roughness Ra of 0.14 μm and a maximum height Ry of 1.0 μm. The same evaluation as in Example 1 was conducted.

Comparative Example 5

Use was made of a mirror-surface machined pipe obtained by turning an A3003 drawn pipe with a polycrystalline diamond cutting tool so as to result in an arithmetic average roughness Ra of 0.15 μm and a maximum height Ry of 1.4 μm. The same evaluation as in Example 1 was conducted.

Evaluation Methods

The electrophotographic photoreceptor substrates of the invention were evaluated based on a visual examination of images formed with the electrophotographic photoreceptor employing each substrate. The images were evaluated for interference fringes, black spots, and black streaks (mainly turning streaks) in half-tone images. In the results of the evaluation, A indicates a satisfactory image, AB indicates an image in which defects were slightly observed, B indicates an image in which defects were observed, and C indicates that critical defects had been developed.

With respect to the surface roughness of each substrate, surface roughness meter "Surfcom 480A", manufactured by Tokyo Seimitsu Co., Ltd., was used to examine the surface in accordance with JIS B0601: 1994 and the found values were converted in accordance with JIS B0601: 2001 to determine the arithmetic average roughness Ra, maximum height/roughness Rz, and kurtosis Rku in a roughness curve. Each value was the average for five measuring points. With respect to groove width L, the minimum and maximum values were determined from a photograph of the surface (magnification, 400 diameters) taken through an examination with an optical microscope.

The results of the evaluations in Examples 1 to 7 and Comparative Examples 1 to 5 are summarized in Table 1.

TABLE 1

Image evaluation results, surface roughness, and groove width

| | | Image Evaluation | | | Surface Roughness | | | Groove Width (μm) | |
|---|---|---|---|---|---|---|---|---|---|
| | | Interference fringe | Black spot | Black streak | Ra (μm) | Rz (μm) | Rku | Minimum | Maximum |
| Example | 1 | AB | A | A | 0.07 | 0.57 | 31 | 0.5 | 1.7 |
| | 2 | A | A | A | 0.10 | 0.69 | 25 | 0.5 | 1.9 |
| | 3 | A | A | A | 0.10 | 0.74 | 13 | 0.7 | 2.3 |
| | 4 | A | A | A | 0.12 | 1.16 | 8.2 | 0.8 | 3.8 |
| | 5 | A | A | A | 0.16 | 1.55 | 6.2 | 0.6 | 3.5 |
| | 6 | A | A | A | 0.17 | 1.64 | 6.3 | 1.1 | 4.8 |
| | 7 | A | AB | A | 0.25 | 2.09 | 3.9 | 1.3 | 6.0 |
| Comparative Example | 1 | C | A | A | 0.04 | 0.68 | 60 | — | — |
| | 2 | C | A | A | 0.03 | 0.20 | 2.3 | — | — |
| | 3 | B | A | A | 0.07 | 0.61 | 2.6 | — | — |
| | 4 | B | A | B | 0.14 | 1.04 | 2.8 | — | — |
| | 5 | A | A | B | 0.15 | 1.42 | 2.7 | — | — |

In the case where the substrate of Example 1, which had undergone surface roughening with a brush having a particle size of #1500, was used, slight interference fringes were observed. In the case where the substrate of Example 7, which had undergone surface roughening with a brush having a particle size of #320, was used, small black spots were slightly observed. Except these, no defects were observed in the case of the substrates of the Examples. Surface roughness and groove width highly correlate with the particle diameter of the abrasive grains. It was ascertained that as the particle diameter increases, the Ra, Rz, and groove width L tend to become larger and the Rku tends to become smaller. Groove width L highly correlates also to processing force. It was ascertained that as the brush revolution speed and the bristle diameter increase, i.e., as the brush contact force becomes stronger, the groove width tends to become larger.

In Comparative Example 1, an ironed pipe was used as it was. The surface of this pipe is in a nearly mirror-surface state and has slight grooves formed by ironing. Because of this, the value of Rku is large, although the Ra and Rz are small. In Comparative Example 2, a pipe was machined to form a mirror surface. However, this substrate has an Rku value of about 2-3 due to the slight serrate surface shape resulting from the turning. In either case, intense interference fringes generate because the substrate surface is a mirror surface. In Comparative Examples 3 to 5, surface roughening was conducted by turning. However, as the recesses/protrusions shown in Comparative Example 4 become larger (Comparative Example 5), turning streaks come to be reflected in the image. On the other hand, as the surface state shown in Comparative Example 4 becomes smoother (Comparative Example 3), interference fringes become apt to appear. In either case, a satisfactory image was not obtained. Furthermore, these substrates each had an Rku value of about 2-3, showing that the surface state thereof was different from that obtained by the invention.

While the invention has been described in detail and with reference to specific embodiments thereof, it will be apparent to one skilled in the art that various changes and modifications can be made therein without departing from the spirit and scope thereof.

This application is based on a Japanese patent application filed on Mar. 4, 2003 (Application No. 2003-056992), the contents thereof being herein incorporated by reference.

INDUSTRIAL APPLICABILITY

The invention can be practiced in any desired field in which an electrophotographic photoreceptor is necessary. For example, it is suitable for use in copiers, printers, printing machines, and the like.

The invention claimed is:

1. An electrically conductive substrate for electrophotographic photoreceptors, which has a groove pattern made by forming many fine grooves at least in almost the whole image formation region in the substrate surface, wherein the grooves are curved and discontinuous when the substrate surface is developed into a plane and the plane is viewed in a direction perpendicular thereto, wherein the substrate surface has a maximum height/roughness Rz of $0.6 \leqq Rz \leqq 2$ μm and a kurtosis Rku of $3.9 \leqq Rku \leqq 30$ and the grooves formed in the substrate surface have a width L of $0.5 \leqq L \leqq 6.0$ μm.

2. The electrophotographic photoreceptor substrate according to claim 1, wherein the groove pattern formed in the substrate surface is a lattice pattern.

3. An electrophotographic photoreceptor which comprises the electrophotographic photoreceptor substrate according to claim 1, and a photosensitive layer formed on the substrate.

4. The electrophotographic photoreceptor according to claim 3, which has an interlayer between the photosensitive layer and the substrate.

5. An electrophotographic photoreceptor cartridge, which comprises:

the electrophotographic photoreceptor according to claim 3 and at least one of a charging unit which charges the electrophotographic photoreceptor, an exposure unit which exposes the charged electrophotographic photoreceptor to light to form an electrostatic latent image, or a developing unit which develops the electrostatic latent image formed on the electrophotographic photoreceptor.

6. An image-forming apparatus, which comprises:

the electrophotographic photoreceptor according to claim 3, a charging unit which charges the electrophotographic photoreceptor, an exposure unit which exposes the charged electrophotographic photoreceptor to light to form an electrostatic latent image, and a developing unit which develops the electrostatic latent image formed on the electrophotographic photoreceptor.

7. The electrophotographic photoreceptor substrate according to claim 1, which is made from a material comprising aluminum.

* * * * *